US005197909A

United States Patent [19]

Rossitto

[11] Patent Number: 5,197,909

[45] Date of Patent: Mar. 30, 1993

[54] OUTBOARD MOTOR WATER PUMP INDICATOR APPARATUS

[76] Inventor: Hugo Rossitto, 611 - 7th St., Lake Charles, La. 70601

[21] Appl. No.: 814,595

[22] Filed: Dec. 30, 1991

[51] Int. Cl.[5] ..... B63H 21/38

[52] U.S. Cl. ..... 440/2; 440/88

[58] Field of Search ..... 440/2, 88

[56] References Cited

U.S. PATENT DOCUMENTS 3,933,114 1/1976 Horn ..... 440/88
4,371,351 2/1983 Tousey ..... 440/88
5,061,214 10/1991 Monaghan ..... 440/88
5,080,617 1/1992 Broughton et al. ..... 440/2

*Primary Examiner*—Sherman Basinger
*Attorney, Agent, or Firm*—Hugh E. Smith

[57] ABSTRACT

An indicator structure for an outboard motor is arranged to direct water pump output flow from the water pump through an associated conduit towards a forward portion of a boat member mounting the outboard motor to provide for visual indication of proper operation of the water pump. A modification of the invention includes an indicator housing, to include an audio and visual indicator contained therewithin operative through the output water flow of the water pump.

3 Claims, 4 Drawing Sheets

OUTBOARD MOTOR WATER PUMP INDICATOR APPARATUS

BACKGROUND OF THE INVENTION

1. Field of the Invention

The field of invention relates to outboard motor apparatus, and more particularly pertains to a new and improved outboard motor water pump indicator apparatus wherein the same provides for visual and audio indication of proper operation of an outboard motor water pump.

2. Description of the Prior Art

In outboard operation, typical motor failure is resultant from water pump failure. To minimize the economic and loss of time resulting from an outboard motor failure, the instant invention attempts to overcome deficiencies of the prior art by providing for indicator structure relative to an outboard motor. While various alarm structure is available in the prior art relative to boats, the prior art has heretofore failed to provide for proper indication of water pump failure relative to an outboard motor.

The U.S. Pat. No. 4,912,464 to Bachman sets forth an indicator alarm for boats and the like to indicate abnormal dragging of an anchor relative to a water bottom.

U.S. Pat. No. 4,904,982 to Lieb, et al. sets forth a visual and audio indicator structure for use relative to a boat of a general electronic cooperation to utilize various input electrical signals to be transformed to audio and visual alarms.

U.S. Pat. No. 3,496,770 to Fassett sets forth a boat indicator apparatus and the U.S. Pat. No. 4,912,465 to Greer sets forth a water position indicator for use in boats.

As such, it may be appreciated that there continues to be a need for a new and improved outboard motor water pump indicator apparatus as set forth by the instant invention which addresses both the problems of ease of use as well as effectiveness in construction in providing proper indication of water pump failure relative to an outboard motor and in this respect, the present invention substantially fulfills this need.

SUMMARY OF THE INVENTION

In view of the foregoing disadvantages inherent in the known types of outboard motor apparatus now present in the prior art, the present invention provides an outboard motor water pump indicator apparatus wherein the same is arranged to provide for visual and optionally audio indication of an outboard motor water pump operation and failure thereof. As such, the general purpose of the present invention, which will be described subsequently in greater detail, is to provide a new and improved outboard motor water pump indicator apparatus which has all the advantages of the prior art outboard motor apparatus and none of the disadvantages.

To attain this, the present invention provides an indicator structure for an outboard motor arranged to direct water pump output flow from the water pump through an associated conduit towards a forward portion of a boat member mounting the outboard motor to provide for visual indication of proper operation of the water pump. A modification of the invention includes an indicator housing, to include an audio and visual indicator contained therewithin operative through the output water flow of the water pump.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved outboard motor water pump indicator apparatus which has all the advantages of the prior art outboard motor apparatus and none of the disadvantages.

It is another object of the present invention to provide a new and improved outboard motor water pump indicator apparatus which may be easily and efficiently manufactured and marketed.

It is a further object of the present invention to provide a new and improved outboard motor water pump indicator apparatus which is of a durable and reliable construction.

An even further object of the present invention is to provide a new and improved outboard motor water pump indicator apparatus which is susceptible of a low cost of manufacture with regard to both materials and labor, and which accordingly is then susceptible of low prices of sale to the consuming public, thereby making such outboard motor water pump indicator apparatus economically available to the buying public.

Still yet another object of the present invention is to provide a new and improved outboard motor water pump indicator apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
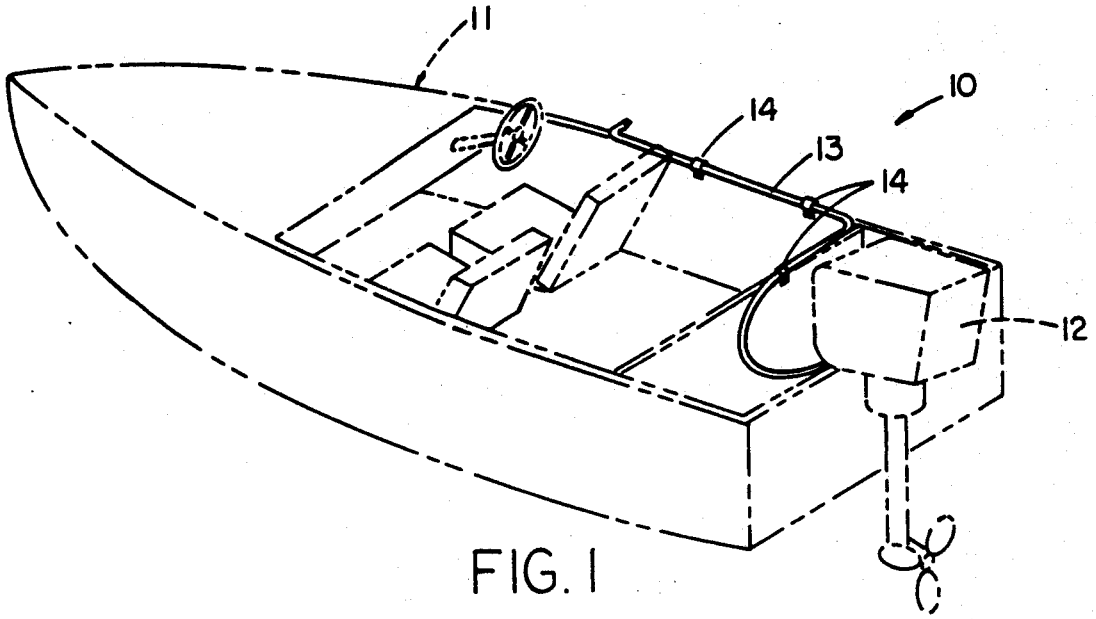
FIG. 1 is an isometric illustration of the invention mounted within a boat structure.
Figure 2:
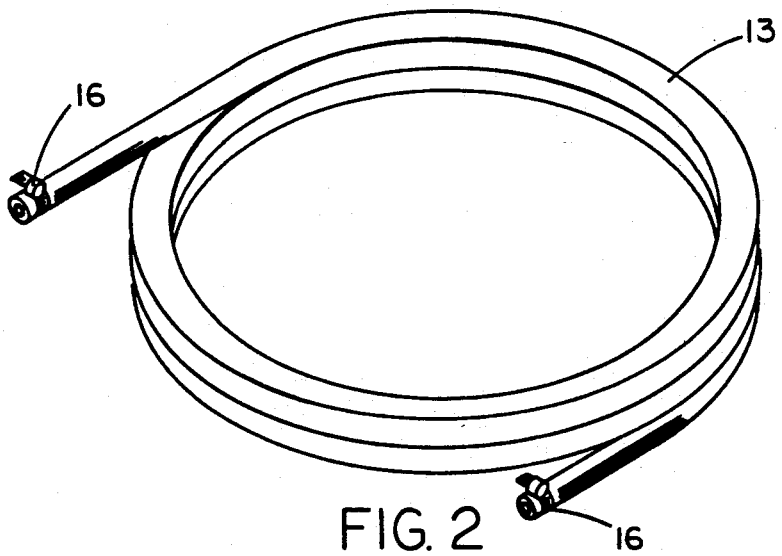
FIG. 2 is an isometric illustration of the flexible directional conduit utilized by the invention.
Figure 3:
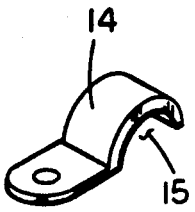
FIG. 3 is an isometric illustration of the mounting bracket structure utilized to secure the directional conduit within the boat structure.

With reference now to the drawings, and in particular to FIGS. 1 to 10 thereof, a new and improved outboard motor water pump indicator apparatus embodying the principles and concepts of the present invention and generally designated by the reference numeral 10 will be described.

Figure 4:
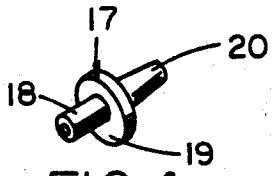
FIG. 4 is an isometric illustration of the adapter conduit arranged for projection into an outboard motor output opening.

More specifically, the outboard motor water pump indicator apparatus 10 of the instant invention essentially comprises the use of a boat member 11 mounting an outboard motor 12 to the stern thereof, in a conventional orientation. A flexible directional conduit 13 is mounted to the outboard motor by use of an adapter conduit 17, as illustrated in FIG. 4. The adapter conduit 17 includes a first conduit 18 arranged for reception within a conventional outboard motor water pump exit port, wherein the first conduit includes an abutment ring 19 orthogonally oriented relative to the first conduit extending radially and exteriorly thereof, wherein a second conduit 20 coaxially aligned with the first conduit is arranged for projection within a first distal end of the directional conduit 13. The directional conduit 13 is thereby directed from the outboard motor 12 throughout the boat 11 and mounted to the boat utilizing a plurality of mounting brackets 14, each mounting bracket including a concave recess 15 to receive the directional conduit 13 to permit ease of securement of the directional conduit to the boat structure.

Figure 5:
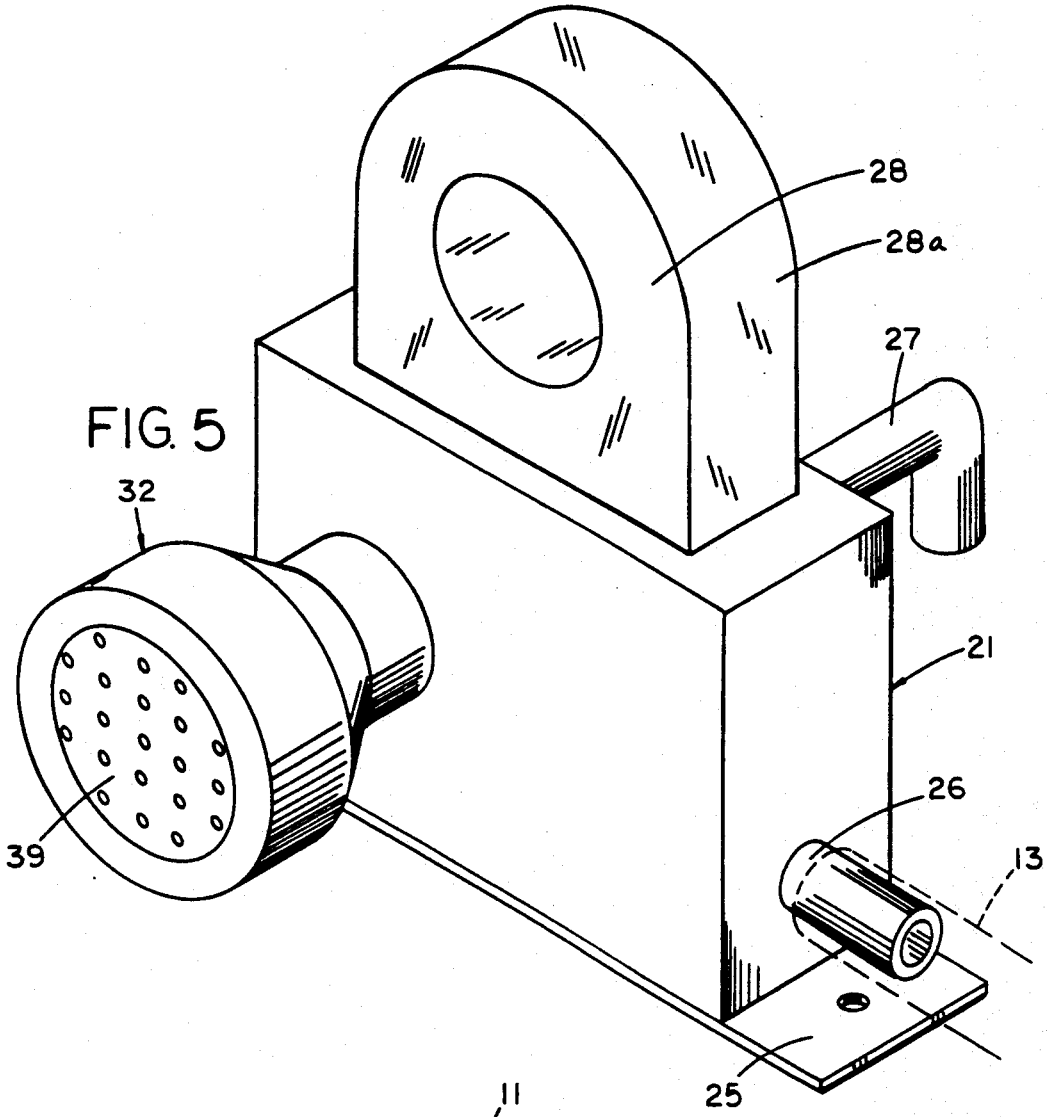
FIG. 5 is an isometric illustration of an audio and visual indicator housing for use by the invention.
Figure 6:
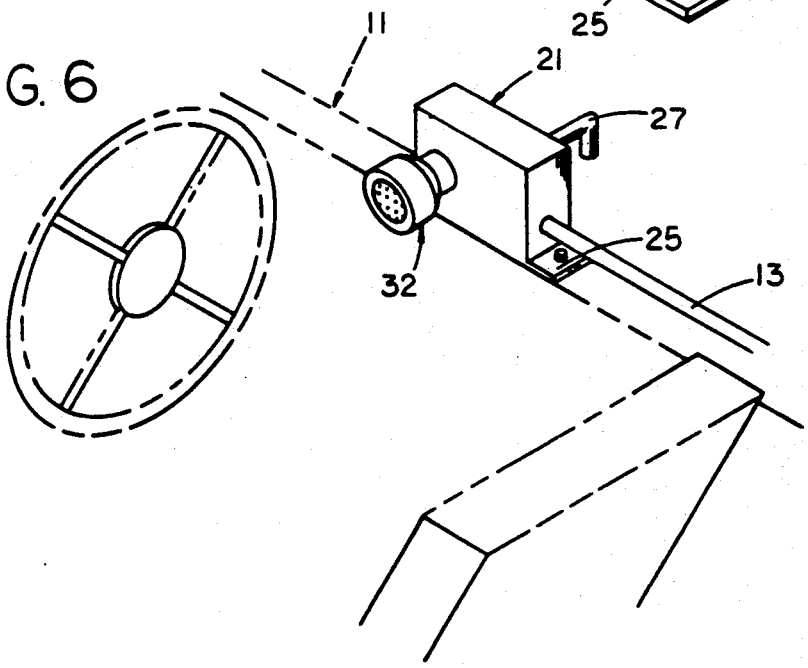
FIG. 6 is an isometric illustration of the indicator housing mounted within the boat structure.
Figure 7:
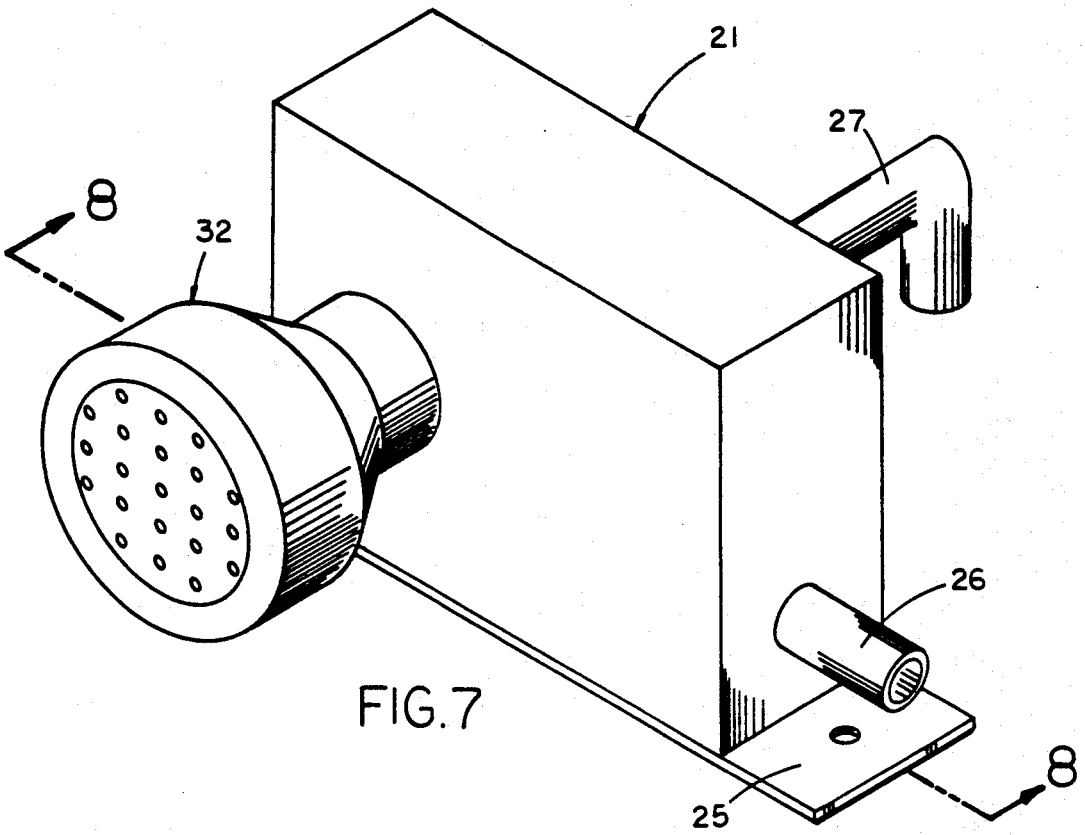
FIG. 7 is an isometric illustration of the audio housing utilized alone.
Figure 8:
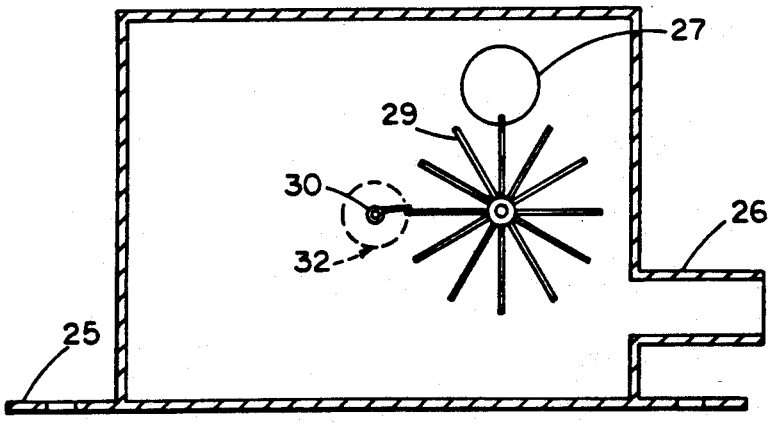
FIG. 8 is an orthographic view, taken along the lines 8—8 of FIG. 7 in the direction indicated by the arrows.
Figure 9:
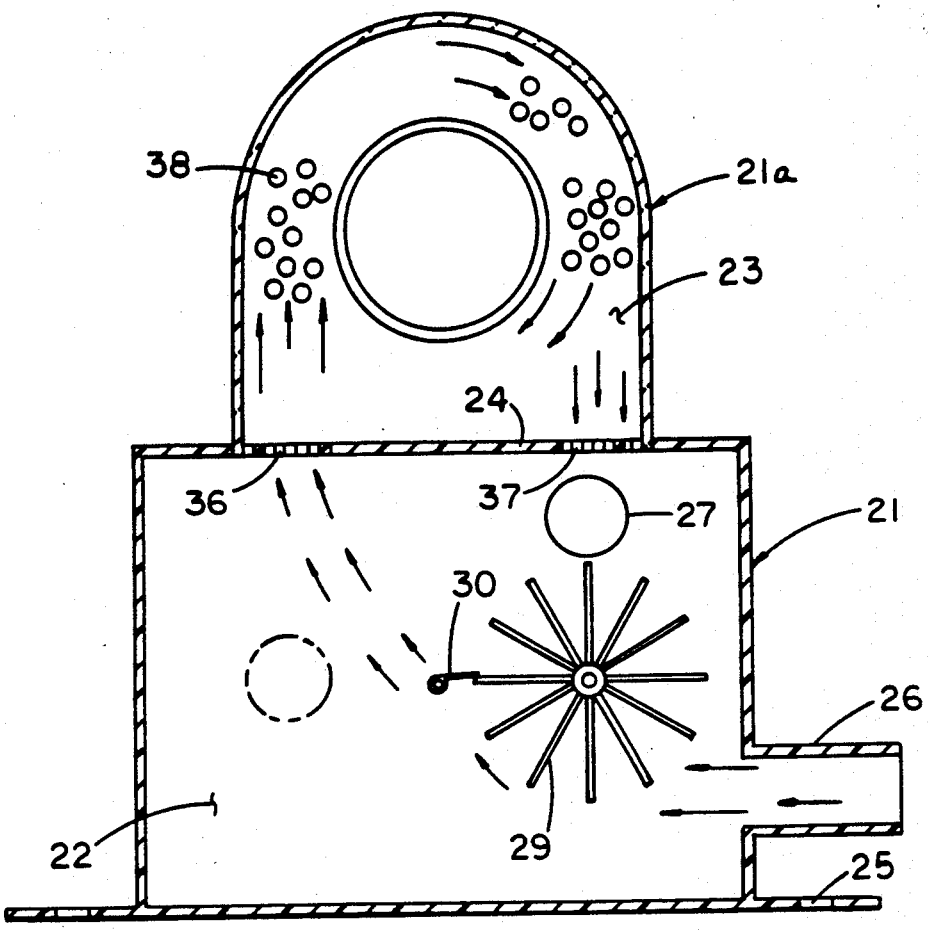
FIG. 9 is an orthographic view of the housing structure of FIG. 5.
Figure 10:
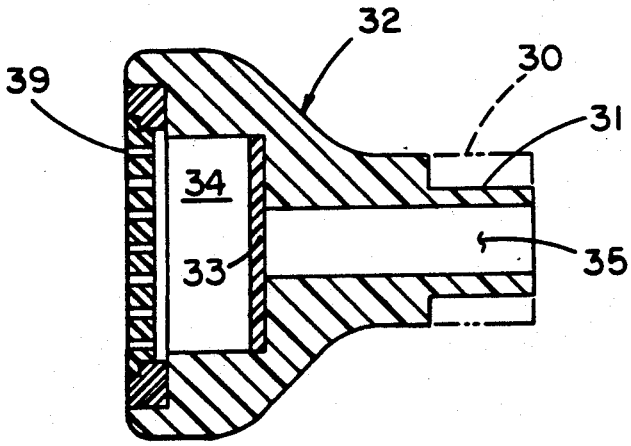
FIG. 10 is an orthographic cross-sectional illustration of the audio housing structure utilized by the invention.

The FIG. 5 illustrates further structure contemplated by the instant invention, wherein an indicator apparatus includes an indicator lower housing 21, with an indicator upper housing 21*a* mounted above the indicator housing to a top wall thereof. The indicator lower housing 21 defines a first chamber 22 therewithin (see FIG. 9) with a circular second chamber 23 defined within the indicator upper housing 21*a*. A separator plate 24 separates the lower housing from the upper housing 21 and 21*a* respectively, wherein the separator plate includes respective first ports directed through a first end of the separator plate, with second ports 37 directed through a second end of the separator plate spaced from the first ports. The second ports are positioned adjacent to and above an indicator housing second conduit to project water exteriorly of the housing, wherein an indicator housing first conduit directs water interiorly of the housing in fluid communication with a second distal end of the directional conduit 13. The indicator housing includes a mounting plate 25 mounted to the boat structure, as illustrated in FIG. 6. The upper housing 21*a* is formed with a transparent front wall 28 and transparent side walls 28*a*, as captured within the circular second chamber 23 are a plurality of multi-colored buoyant flotation members 38 that are directed throughout the circular second chamber upon projection of fluid from the indicator housing first conduit 26 through the first chamber 22 and through the first ports 36. The fluid thereby directed through the second chamber is directed to the second chamber by a spoked paddle wheel 29 whose paddles are positioned in confrontation to the first conduit 26 directed through the first chamber to effect rotation of the paddle wheel. The paddle wheel is also arranged to strike a flexible abutment flange 30. The flexible abutment flange 30 is mounted to a rear distal portion or audio housing rear shaft 31 of the audio housing 32 that projects through the front wall of the lower housing 22. A flexible membrane 33 separates an audio housing second chamber 35 from an audio housing first chamber 34. The flexible abutment flange 30 upon being struck effects resonanse throughout the rigid audio housing 32 directed through a forward speaker grill 39 formed as a forward wall of the audio housing 32. Further, the lower housing may be utilized alone, in a manner as illustrated in the FIGS. 7 and 8, or utilized in combination with the upper housing 21*a*, as illustrated in the FIGS. 5 and 9 for example.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An outboard motor water pump indicator apparatus for use in combination with an outboard motor mounted to a boat member, wherein the apparatus comprises, an adapter member arranged for projection within an exit port of an outboard motor, wherein the adapter member includes a first conduit arranged for projection within the exit port, with an abutment ring projecting radially and exteriorly of the first conduit at a forward distal end of the first conduit, and a second conduit projecting from the abutment ring coaxially aligned with the first conduit, wherein the first conduit and second conduit are in fluid communication relative to one another, and a flexible directional conduit, including a first distal end mounted to the second conduit, and a second distal end projecting forwardly of the outboard motor for directing water flow from the outboard motor through the second distal end, and a plurality of mounting brackets secured to the boat member receiving the flexible conduit therewithin, wherein each mounting bracket includes a concave recess arranged for receiving the flexible conduit, and an indicator assembly, wherein the indicator assembly includes an indicator lower housing, the indicator lower housing including a mounting plate, the mounting plate arranged for securement to the boat member, and the lower housing including a first conduit directed through a side wall of the lower housing, the first conduit in fluid communication with the second distal end of the directional conduit, and the lower housing including a first chamber contained within the lower housing, the first chamber including a spoked paddle wheel rotatably mounted within the first chamber, the spoked paddle wheel includes a plurality of paddle plates, and the paddle plates are positioned adjacent to and in confrontation with the first conduit directed into the first chamber to effect rotation of the spoked paddle wheel, and an audio housing mounted to a front wall of the lower housing, the audio housing including an audio housing first chamber positioned exteriorly of the lower housing rearwardly of a speaker grill and positioned forwardly of a flexible membrane, and coaxially aligned when the audio housing first chamber is an audio housing second chamber projecting into the first chamber of the lower housing, and the audio housing further including a flexible abutment flange mounted to a rear distal end of the audio housing within the first chamber, wherein the abutment flange is arranged for abutment with the spoked paddle wheel for impact of the abutment flange by the paddle wheel, wherein audio resonance is directed through the audio housing and the flexible membrane and the speaker grill.

2. An apparatus as set forth in claim 1 wherein the lower housing includes an upper housing mounted to a top wall of the lower housing and a separator plate defining an interface between the upper housing and the lower housing, and the upper housing includes a transparent front wall and a transparent side wall, and the separator plate includes first ports directed through a first end of the separator plate, and second ports directed through a second end of the separator plate, wherein the second ports are positioned above a lower housing second conduit projecting exteriorly of the lower chamber to permit egress of fluid flow therethrough.

3. An apparatus as set forth in claim 2 wherein the upper housing includes a circular second chamber, the circular second chamber includes a plurality of colored buoyant flotation members contained therewithin whereupon direction of fluid flow into the second chamber through the first ports effects agitation of the flotation members within the second chamber for visual inspection.

* * * * *